US007306435B2

(12) United States Patent
Wulf

(10) Patent No.: US 7,306,435 B2
(45) Date of Patent: Dec. 11, 2007

(54) APPARATUS AND METHOD FOR ANCHORING A ROTOR BLADE IN A ROTOR OF A TURBO MACHINE

(75) Inventor: Joachim Wulf, Munich (DE)

(73) Assignee: MTU Aero Engines GmbH, Munich (DE)

( * ) Notice: Subject to any disclaimer, the term of this patent is extended or adjusted under 35 U.S.C. 154(b) by 62 days.

(21) Appl. No.: 11/271,296

(22) Filed: Nov. 12, 2005

(65) Prior Publication Data

US 2006/0239822 A1 Oct. 26, 2006

(30) Foreign Application Priority Data

Nov. 13, 2004 (DE) ..... 10 2004 054 930

(51) Int. Cl.
*F01D 5/32* (2006.01)

(52) U.S. Cl. ..... 416/220 R

(58) Field of Classification Search ..... 416/193 A, 416/220 R

See application file for complete search history.

(56) References Cited

U.S. PATENT DOCUMENTS 3,043,562 A * 7/1962 Van Nest et al. ..... 416/221
3,501,249 A * 3/1970 Scalzo et al. ..... 416/95
3,656,865 A 4/1972 Spears, Jr.
3,904,317 A 9/1975 Cardin et al.
5,256,035 A * 10/1993 Norris et al. ..... 416/220 R

FOREIGN PATENT DOCUMENTS

| | | |
|---|---|---|
| EP | 0 761 930 A1 | 3/1997 |
| FR | 1.536.134 | 8/1968 |
| GB | 1 209 419 | 10/1970 |

* cited by examiner

*Primary Examiner*—Ninh H. Nguyen
(74) *Attorney, Agent, or Firm*—Crowell & Moring LLP

(57) ABSTRACT

A rotor of a turbo machine having a rotor base and a plurality of rotor blades. Each rotor blade is anchored in an axial groove of the rotor base body via the blade footing and the rotor blades are secured in the rotor base body by locking plates which are guided in ring grooves of the rotor base body and the rotor blades. The locking plates have a diamond-shaped outline, in particular in the form of a parallelogram or a rhombus such that in an insertion position, the locking plates can be inserted between the rotor base body and the rotor blades, and in an installation position, which is rotated with respect to this insertion position, they can be rotated into the ring grooves of the rotor base body and the rotor blades.

12 Claims, 5 Drawing Sheets

APPARATUS AND METHOD FOR ANCHORING A ROTOR BLADE IN A ROTOR OF A TURBO MACHINE

This application claims the priority of German Patent Document No. 10 2004 054 930.3, filed Nov. 13, 2004, the disclosure of which is expressly incorporated by reference herein.

BACKGROUND AND SUMMARY OF THE INVENTION

This invention relates to a rotor of a turbo machine, in particular a gas turbine rotor.

Rotors of a turbo machine such as gas turbine rotors have a rotor base body and multiple rotor blades rotating with the rotor base body. The present invention relates to a rotor of a turbo machine, in particular a gas turbine rotor, in which the rotor blades are attached via the blade footing in grooves running in the axial direction of the rotor base body, i.e., in axial grooves.

In gas turbine rotors in which the rotor blades are anchored in axial grooves of the rotor base body via the blade footing, so-called locking plates are used to secure the rotor blades axially. In the installed state, these locking plates are guided in a ring groove in the rotor base body and in a ring groove in the rotor blades anchored in the rotor base body. According to the state of the art, the locking plates are designed to be shaped with a rectangular outline, whereby one or more rotor blades in the preinstalled rotor assembly must be displaced in the axial direction for installation of these rectangular locking plates in the ring grooves of the rotor base body and the rotor blades in order to permit insertion of the locking plates into the ring grooves. To do so, an enlarged clearance is required between the blade footing of the rotor blades and the axial grooves of the rotor base body. However, such an enlarged footing clearance has a negative effect on the strength of the rotor blades.

Against this background, the problem on which the present invention is based is to create a novel rotor for a turbo machine.

According to the invention, the locking plates have a diamond shape, in particular a parallelogram shape or a rhomboid shape such that, in an insertion position, the locking plates can be inserted between the rotor base body and the blade platforms of the rotor blades, and in an installation position, which is rotated with respect to this insertion position, the locking plates can be rotated into the ring grooves of the base body and the blade platforms. In the insertion position of the locking plates, a radial width thereof is smaller than the distance between an edge defining the ring groove of the rotor base body and an edge defining the ring groove of the blade platforms. In the installation position, however, the radial width of the locking plates is greater than the distance between the edge defining the ring groove of the rotor base body and the edge defining the ring groove of the blade platform.

In the sense of the present invention, a rotor for a turbo machine is provided, in particular a gas turbine rotor in which the locking plates for axially securing the rotor blades, which are guided in axial grooves via the blade footing, are designed to be diamond-shaped. The locking plates are preferably designed like parallelograms or rhomboids, where the edges of the locking plates may either run in a straight line or may form arcs of a curve and are adapted to the groove diameter. Due to the inventive contour of the locking plates, they can be inserted easily, i.e., with no problem, between the rotor base body and the blade platforms of the rotor blades. To insert these locking plates into the ring grooves of rotor base bodies and rotor blades, the locking plates are simply rotated. This makes it possible to minimize the play between the blade footing of the rotor blades and the axial grooves of the rotor base body. This increases the strength of the blade footing.

In the installation position of the locking plates in which they are rotated into the ring grooves of the rotor base body and the blade platforms, a connecting line preferably runs between two radially opposed corner points of a locking plate through a midpoint of the rotor base body. A center of gravity of the locking plates is thus offset with respect to the connecting lines running through the midpoint of the rotor base body such that the locking plates automatically stabilize themselves in their installation position during operation of the rotor.

BRIEF DESCRIPTION OF THE DRAWINGS

Preferred embodiments of the present invention are derived from the following description. Exemplary embodiments of the present invention are explained in greater detail with reference to the drawings without being limited to those embodiments.

DETAILED DESCRIPTION OF THE DRAWINGS

Before describing exemplary embodiments of the present invention in greater detail below with reference to FIGS. 3 through 6, a gas turbine rotor known from the state of the art and having the blade footings of the rotor blades guided in axial grooves will be described first with reference to FIGS. 1 and 2.

Figure 1:
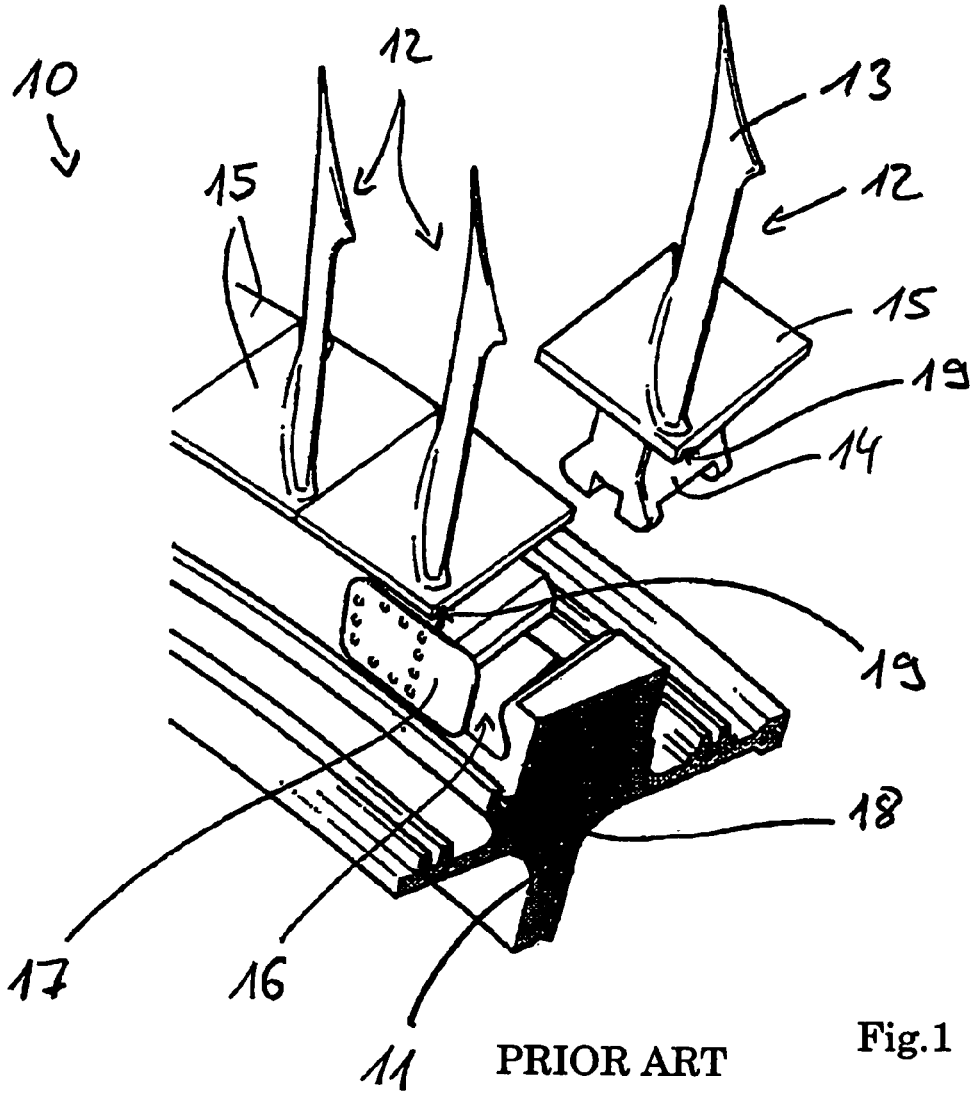
PRIOR ART Fig.1
FIG. 1 is a detail of a gas turbine rotor according to the state of the art as seen in a perspective side view.
Figure 2:
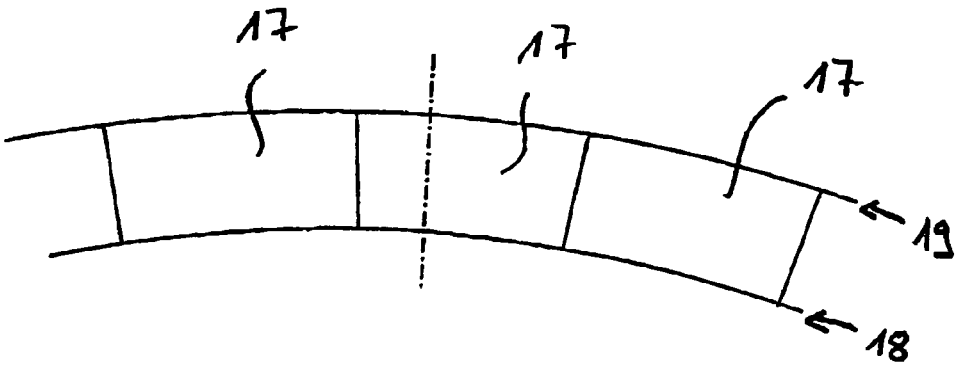
Fig. 2 PRIOR ART
FIG. 2 is a view of the locking plates of the gas turbine rotor known from the state of the art as shown in FIG. 1.
Figure 3A:
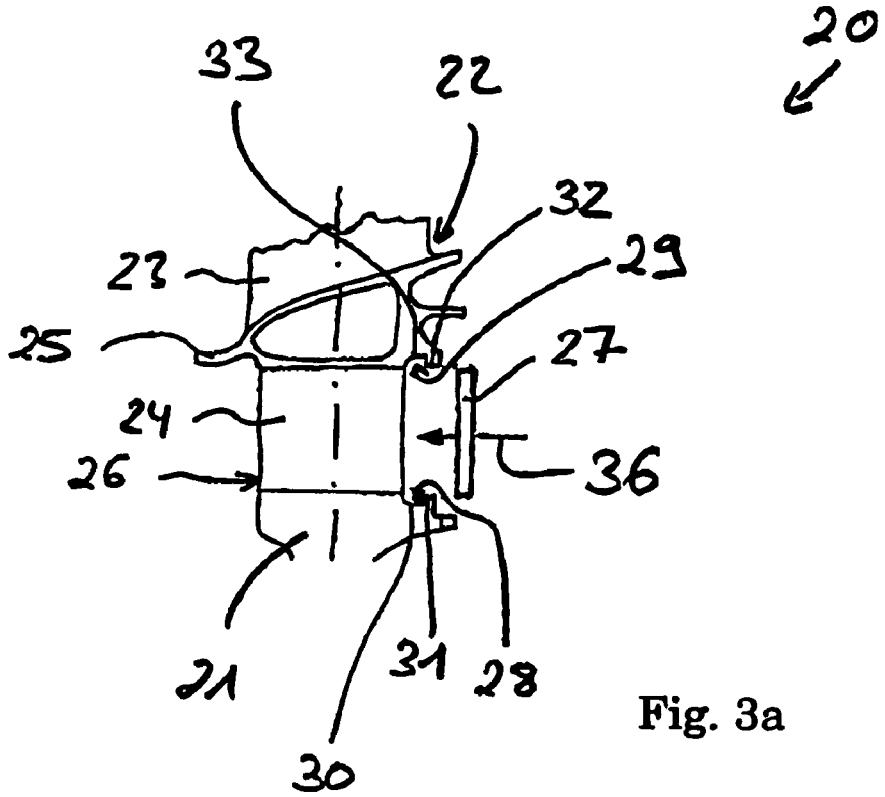
FIGS. 3*a*-3*d* are various views of a gas turbine rotor according to the present invention together with the locking plates designed according to the present invention.
Figure 3B:
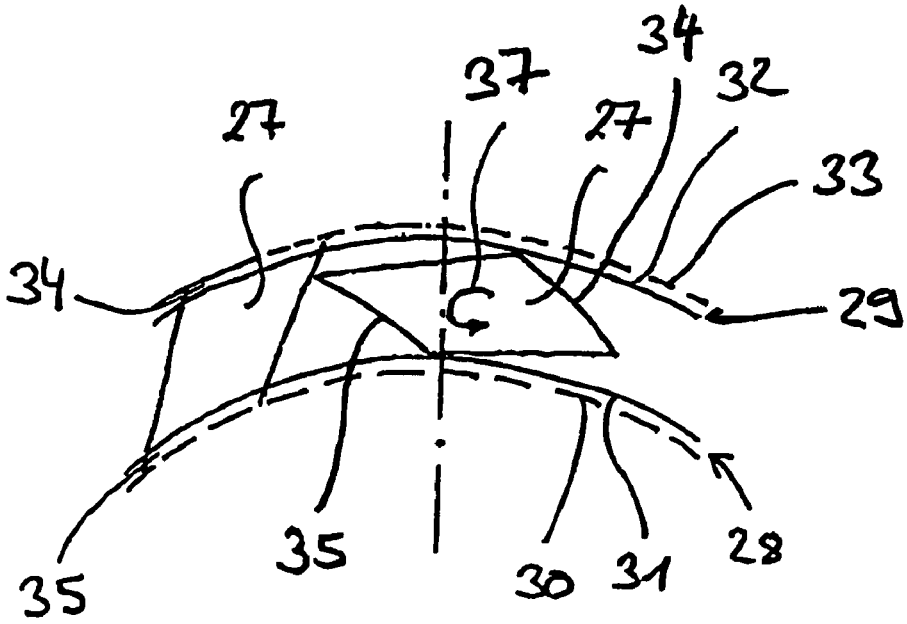
Figure 3C:
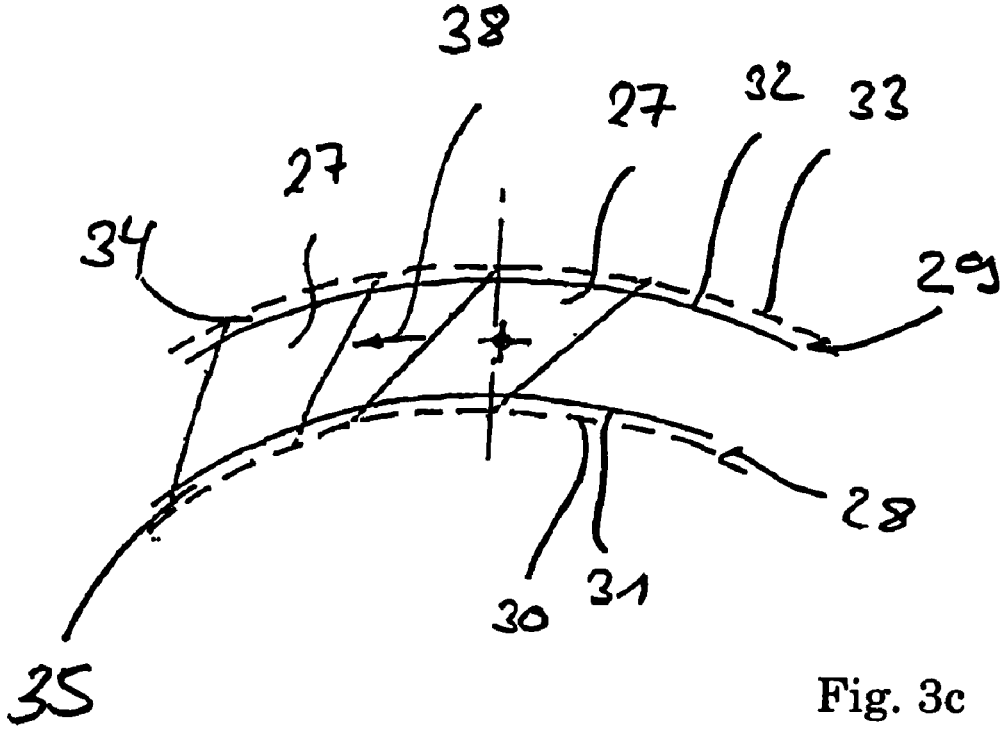
Figure 3D:
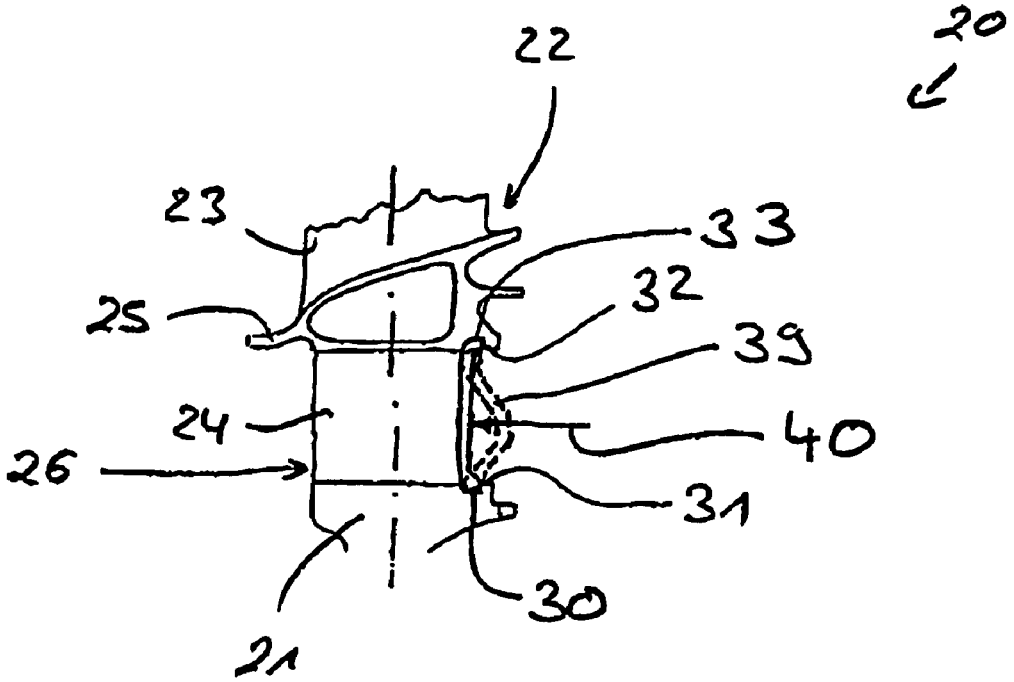

FIGS. 1 and 2 show a gas turbine rotor 10, which is known from the state of the art and has a rotor base body 11 plus multiple rotor blades 12. Each of the rotor blades 12 has a blade pan 13 and a blade footing 14 with a blade platform 15 being formed between the blade pan 13 and the blade footing 14. Multiple axial grooves 16 running in the axial direction are provided in the rotor base body 11, each rotor blade 12 with its blade footing 14 being anchored in such an axial groove 16 in the rotor base body 11. As shown in FIG. 1, the axial grooves 16 may be pitched in the circumferential direction. To axially secure the rotor blades 12 inserted into the axial groove 16, locking plates 17 are used. The locking plates 17 are guided in a ring groove 18 of the rotor base body 11 on the one hand and on the other hand in ring grooves 19 of the blade platforms 15. As indicated in FIGS. 1 and 2, the locking plates 17 according to the state of the art have a rectangular outline which necessitates shifting one or more rotor blades 12 in the premounted rotor assembly in the axial direction to insert the locking plates 17 into the ring grooves 18 and/or 19. To permit an adequate axial displacement of one or more rotor blades 12 in the rotor assembly, according to the state of the art an enlargement of a footing clearance between the blade footing 14 and the respective axial groove 16 is necessary, but this is a disadvantage for strength reasons. This is true in particular of rotor blades having an outer cover band and so-called Z-teeth in the area of the outer cover band.

In highly schematic diagrams, FIGS. 3*a* through 3*d* show different views of a gas turbine rotor 20 according to this invention, which in turn has a rotor base body 21 and multiple rotor blades 22. Each rotor blade 22 has a blade pan 23, blade footing 24 and a blade platform 25, where the blade platform 25 is positioned between the blade footing 24 and the blade pan 23. The rotor blades 22 are anchored with the blade footing 24 in axial grooves 26 of the rotor base body 21, resulting in the rotor blades 22 being secured axially in the axial grooves 26 by means of locking plates 27. To this end, the locking plates 27 engage in a ring groove 28 of the rotor base body 21 and in a ring groove 29 of the blade platform 25.

As indicated in FIGS. 3*a* through 3*d*, the ring groove 28 of the rotor base body 21 may be defined by an inside radial edge 30 and an outside radial edge 31, the ring groove 29 of the rotor blades 22 being defined by an inside radial edge 32 and an outside radial edge 33. To secure the rotor blades 22 axially, the locking plates must engage in the ring grooves 28 and 29 in such a way that, as seen in projection, a radial outside edge 34 of the locking plates is covered by the inside radial edge 32 of the ring groove 29 of the rotor blades 22, and an inside radial edge 35 of the locking plates 27 is covered by the outside radial edge 31 of the ring groove 28 of the rotor base body 21. For inserting the locking plates 27 into the ring grooves 28 and 29, however, they must be threaded between the outside radial edge 31 of the ring groove 28 of the rotor base body 21 and the inside radial edge 32 of the ring groove 29 of the rotor blade 22.

In the sense of the present invention, it is provided that the locking plates 27 shall have a diamond shape, in particular a parallelogram-like shape or a rhomboid shape, so that in the insertion position (see FIGS. 3*a* and 3*b*) the locking plates 27 can be inserted between the rotor base body 21 and the rotor blades 22, namely between the outside radial edge 31 of the ring groove 28 of the base body 21 and the inside radial edge 32 of the ring groove 29 of the rotor blades 22. In an installation position that is rotated with respect to this insertion position (see FIG. 3*c*), the locking plates 27 with their edges 34 and 35 engage in the ring grooves 28 and 29, their edges 34 and 35 thus being covered in the installation position by the outside radial edge 31 of the ring groove 28 of the rotor base body 21 and the inside radial edge 32 of the ring groove 29 of the rotor blades 22. For installation of the locking plates 27, the procedure followed in the sense of the present invention is to insert the locking plates 27 in their rotated insertion position (see FIG. 3*a*) in the sense of the arrow 36 between the rotor base body 21 and the rotor blade 22 in order to then be rotated in this inserted position in a sense of arrow 37 (see FIG. 3*b*) into their installation position. A locking plate 27 rotated into the installation position is then shifted in the direction of arrow 38 (see FIG. 3*c*) in the circumferential direction until the locking plate comes to rest against a locking plate 27 that has already been installed. Locking plates rotated into their installation position in this way are secured by at least one plastically deformable closing element 39 which is pressed into the ring grooves 28 and 29 in the direction of arrow 40 (see FIG. 3*d*).

Figure 4:
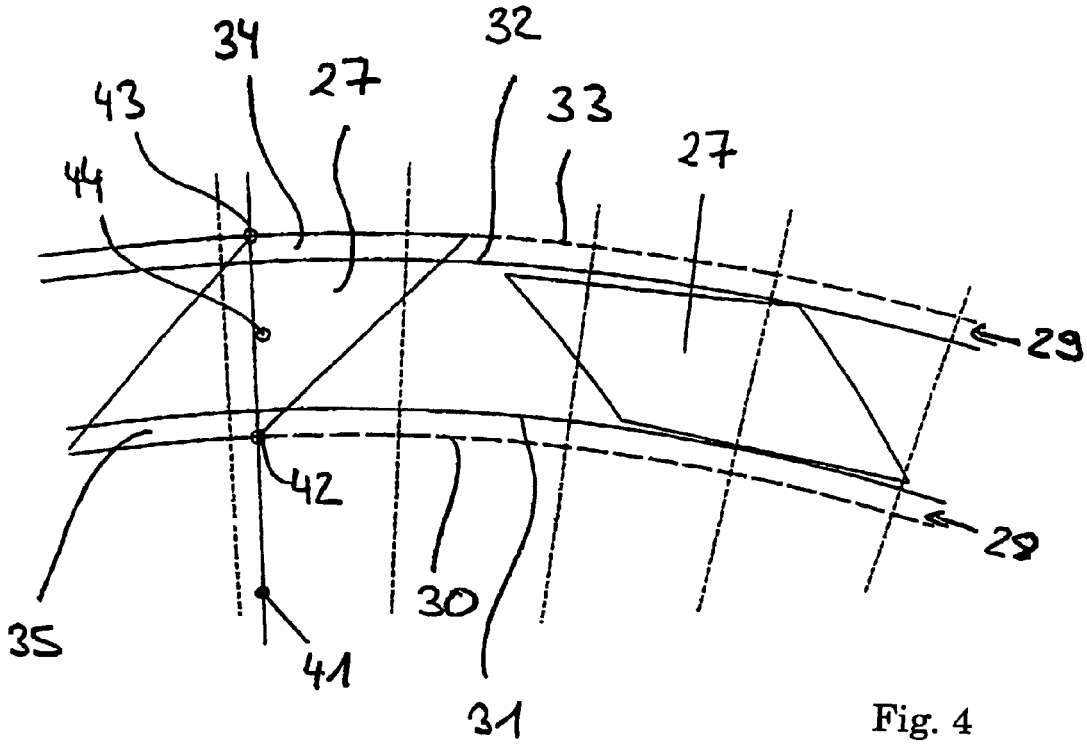
FIG. 4 is another view of the locking plates designed according to the present invention.

As FIG. 4 indicates, a connecting line 41 runs between two radially opposed corner points 42 and 43 of a locking plate 27 through a midpoint (not shown) of the rotor base body 21 in the installed position of the locking plates 27. A center of gravity 44 of the locking plates 27 is offset with respect to the connecting lines 41.

Figure 5:
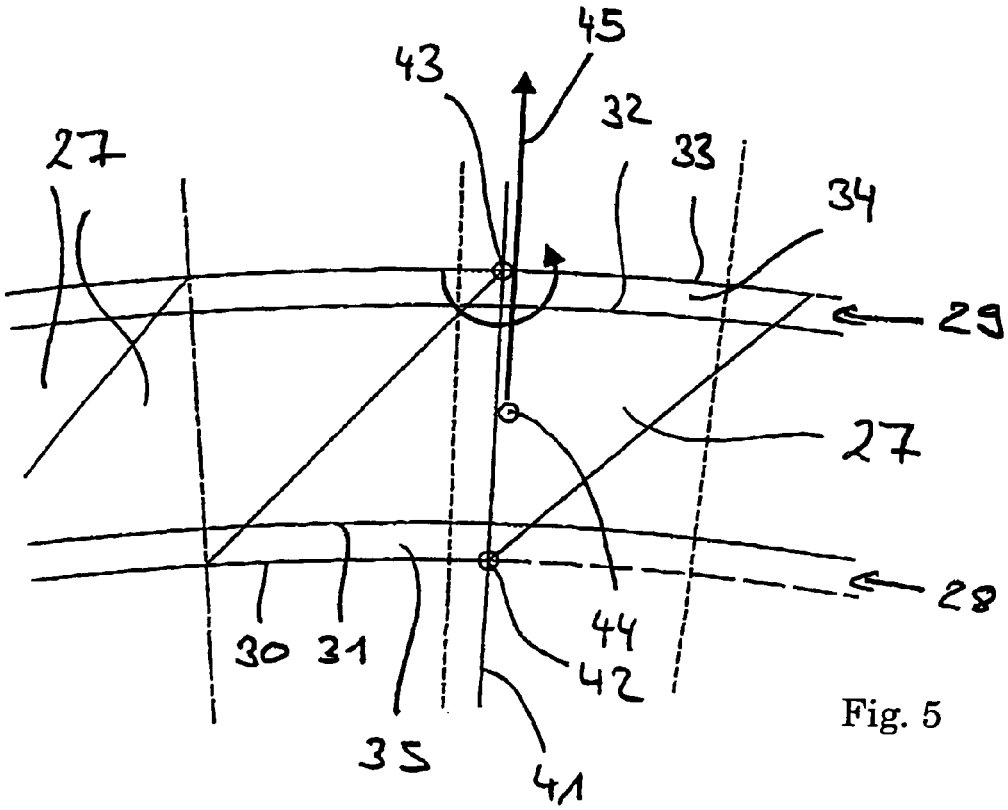
FIG. 5 is another view of the locking plates designed according to the present invention.

It is in the sense of the present invention for the center of gravity 44 to be offset with respect to the connecting lines 41 such that the locking plates 27 are automatically stabilized in their installation position during operation of the rotor. FIG. 5 thus illustrates centrifugal forces acting on the locking plates 27 during operation, indicated by the arrow 45, producing automatic stabilization of the locking plates 27 under the influence of centrifugal force due to the position of the center of gravity 44 in relation to the connecting lines 41 and/or the pivot point defined by the corner point 43 of the locking plates 27. Because of the position of the center of gravity 44, the position of the locking plates 27 is thus automatically stabilized, so that in the event of loss of a single locking plate 27 or a closing element 39 during operation, other locking plates 27 need not necessarily be lost. This increases the security of the axial fixation of the rotor blades 22.

The diagrams of FIGS. 4 through 5 show all of the locking plates 27 designed in the form of parallelograms having straight edges. Two opposing edges run essentially parallel to one another.

Figure 6:
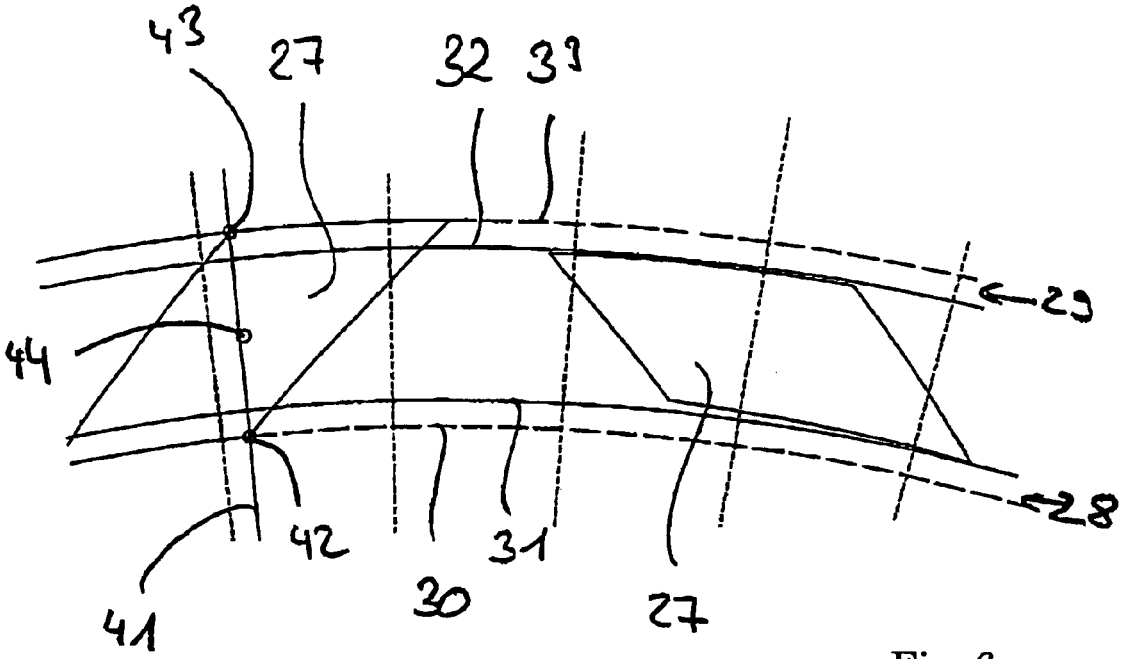
FIG. 6 is a view of alternative locking plates designed according to the present invention.

As FIG. 6 shows, the locking plates 27 may also have edges running in the form of arcs of a circle. This permits better adaptation of the contour of the locking plates 27 to the ring grooves 28 and 29 but the manufacturing complexity of the locking plates 27 with edges running in the form of arcs of a circle is greater than the manufacturing complexity for locking plates 27 having edges running in a straight line.

In comparison with the state of the art, no increase in play between the blade footing 24 of the rotor blades 22 and the axial grooves 26 of the rotor base body 21 is necessary for installation of the locking plates 27 with the rotor according to the present invention. The strength of the rotor blades is influenced in a positive sense in this way. In addition, the locking plates can be installed easily.

LIST OF REFERENCE NUMERALS

10 gas turbine rotor
11 rotor base body
12 rotor blade
13 blade pan
14 blade footing
15 blade platform
16 axial groove
17 locking plate
18 ring groove
19 ring groove
20 gas turbine rotor
21 rotor base body
22 rotor blade
23 blade pan
24 blade footing
25 blade platform
26 axial groove
27 locking plate
28 ring groove
29 ring groove
30 edge
31 edge
32 edge
33 edge

34 edge
35 edge
36 direction of movement
37 direction of movement
38 direction of movement
39 closing element
40 direction of movement
41 connecting line
42 corner point
43 corner point
44 center of gravity
45 centrifugal force direction The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A rotor of a turbo machine, in particular a gas turbine rotor, having a rotor base body wherein the rotor base body has a plurality of axial grooves extending in an axial direction and/or in a direction of flow and having a plurality of rotor blades, each rotor blade being anchored in an axial groove of the rotor base body by a blade footing and the rotor blades being secured in an anchored position in the rotor base body to prevent displacement in the axial direction by means of locking plates, which are guided in ring grooves of the rotor base body and the rotor blades, wherein the locking plates have a diamond-like outline, in particular resembling a parallelogram or a rhombus, such that in an insertion position, the locking plates are insertable between the rotor base body and the rotor blades and in an installation position are rotated with respect to the insertion position, and wherein the locking plates are rotatable into the ring grooves of the rotor base body and the rotor blades.

2. The rotor according to claim 1, wherein in the installation position of the locking plates in which the locking plates are rotated into the ring grooves of the rotor base body and the rotor blades, a connecting line runs between two radially opposed corner points of a locking plate through a midpoint of the rotor base body.

3. The rotor according to claim 2, wherein a center of gravity of the locking plate is offset with respect to the connecting line running through the midpoint of the rotor base body.

4. The rotor according to claim 3, wherein the center of gravity of the locking plate is offset with respect to the connecting line running through the midpoint of the rotor base body such that the locking plate is automatically stabilized in the installation position during an operation of the rotor.

5. The rotor according to claim 1, wherein edges of the locking plates, which define the diamond-like outline of the locking plates, in particular the parallelogram or rhombus-like outline, run in a straight line.

6. The rotor according claim 1, wherein edges of the locking plates which define the diamond-like outline of the locking plates, in particular the parallelogram or rhombus-like outline, run in a form of an arc of a circle.

7. The rotor according to claim 1, wherein the locking plates which are rotated into an installed position are secured by a plastically deformable closing element.

8. The rotor according to claim 1, wherein in the insertion position of the locking plates, a radial width of the locking plates is smaller than a distance between an edge defining the ring groove of the rotor base body and an edge defining the ring groove of the rotor blades, and in an installed position a radial width of the locking plates is greater than the distance between the edge defining the ring groove of the rotor base body and the edge defining the ring groove of the rotor blades.

9. A gas turbine, in particular an aircraft engine, having at least one rotor having a rotor base body wherein the rotor base body has a plurality of axial grooves extending in an axial direction and/or in a direction of flow and having a plurality of rotor blades, each rotor blade being anchored in an axial groove of the rotor base body by a blade footing and the rotor blades being secured in an anchored position in the rotor base body to prevent displacement in the axial direction by means of locking plates, which are guided in ring grooves of the rotor base body and the rotor blades, wherein the locking plates have a diamond-like outline, in particular resembling a parallelogram or a rhombus, such that in an insertion position, the locking plates are insertable between the rotor base body and the rotor blades and in an installation position are rotated with respect to the insertion position, and wherein the locking plates are rotatable into the ring grooves of the rotor base body and the rotor blades.

10. A rotor of a turbo machine, comprising:

a rotor base body defining a first ring groove;

a rotor blade defining a second ring groove; and a locking plate having a diamond-like configuration;

wherein the rotor blade is anchored in the rotor base body and wherein the locking plate is disposed within the first and second ring grooves.

11. A method for installing a locking plate in a rotor of a turbo machine, comprising the steps of:

inserting the locking plate between a first ring groove defined by a rotor base body and a second ring groove defined by a rotor blade; and rotating the locking plate such that a first edge of the locking plate engages in the first ring groove and a second edge of the locking plate engages in the second ring groove.

12. The method of claim 11, wherein the locking plate has a diamond-like configuration.

* * * * *